US005236122A

United States Patent [19]

Ballard

[11] Patent Number: 5,236,122

[45] Date of Patent: Aug. 17, 1993

[54] PILFER PROOF CONTAINER

[75] Inventor: Jeffrey A. Ballard, Dayton, Ohio

[73] Assignee: Greif Bros. Corporation, Delaware, Ohio

[21] Appl. No.: 925,438

[22] Filed: Sep. 23, 1992

[51] Int. Cl.[5] ..... B65D 5/02

[52] U.S. Cl. ..... 229/102; 229/153; 229/173; 229/178

[58] Field of Search ..... 229/102, 165, 172, 173, 229/178, 128, 149, 150, 152, 153

[56] References Cited

U.S. PATENT DOCUMENTS

| | | | |
|---|---|---|---|
| 921,197 | 5/1909 | Zell . | |
| 1,108,464 | 8/1914 | Morey | 229/102 |
| 2,279,233 | 4/1942 | Groves . | |
| 2,698,125 | 12/1954 | Vizcarrondo et al. . | |
| 2,736,487 | 2/1956 | George . | |
| 2,788,932 | 4/1957 | German, Jr. | 229/174 X |
| 2,832,526 | 4/1958 | Small . | |
| 2,845,211 | 7/1958 | Hauck et al. | 279/178 X |
| 2,939,621 | 6/1960 | Mittleman | 229/130 X |
| 2,953,292 | 9/1960 | McCall | 229/178 X |
| 3,021,043 | 2/1962 | Phin . | |
| 3,088,651 | 5/1963 | Rasmusson . | |
| 3,181,771 | 5/1965 | Galloway . | |
| 3,191,845 | 6/1965 | Wainberg . | |
| 3,233,818 | 2/1966 | Bixler et al. | 229/102 X |
| 3,291,367 | 12/1966 | Carter | 229/178 X |
| 3,451,535 | 6/1969 | Caplan | 229/102 X |
| 3,790,064 | 2/1974 | Kramer . | |
| 4,129,247 | 12/1978 | McCall . | |
| 4,244,507 | 1/1981 | Garmon . | |
| 4,257,550 | 3/1981 | Frohlicher | 229/178 X |
| 4,535,929 | 8/1985 | Sherman, II et al. . | |
| 4,830,270 | 5/1989 | Holmes | 229/102 |

*Primary Examiner*—Allan N. Shoap
*Assistant Examiner*—Chris McDonald
*Attorney, Agent, or Firm*—Kane, Dalsimer, Sullivan, Kurucz, Levy, Eisele & Richard

[57] ABSTRACT

A pilfer proof container made from a one piece die cut which is folded into the container which has a generally rectangular configuration with the lid locked into position by way of a locking arrangement between a score or opening in the front panel of the container and a flange member coupled to the lid.

5 Claims, 7 Drawing Sheets

TOP

PILFER PROOF CONTAINER

FIELD OF THE INVENTION

The present invention relates to a container of pilfer proof construction formed from a single blank of corrugated paper or fiber board.

BACKGROUND OF THE INVENTION

There exists many forms of containers on the market manufactured out of different material. The use of corrugated fiber board or cardboard is popular due to its inexpensive and relative sturdiness. Often times such containers are constructed using fasteners such as staples, adhesives or tape to hold them together. The use of such fasteners particularly with regard to the lid or top flange allows the opening and resecuring of the lid. While this is desirable in certain instances, it is undesirable in others. For example, in the shipping of currency e.g. rolled coins, a pilferproof feature rather then reclosable one is desired.

It is also desired that the container be relatively inexpensive and of a sturdy construction to contain the items such as rolled coins, etc. In addition, the container should be readily constructed and fully sealable without the use of staples, adhesive or tape to maintain its pilferproof feature.

SUMMARY OF THE INVENTION

It is therefore, an object of the invention to provide for a pilferproof container which is relatively inexpensive but of sturdy construction.

It is another object of the invention to provide such a container which may be made out of a single blank of material, is readily assembled and provides for self-locking thereof.

In this regard, the present invention provides for a pilferproof container made from a single blank of material such as cardboard, paper or fiber board. The blank includes a plurality of sides, tabs, flaps and slots all formed from the single blank. The container is formed through the interlocking of various elements which are hingedly joined together. A top lid includes a flap portion which, after the desired contents have been placed in container, is inserted into a slit in the front of the container. This flap includes a doubled over portion which when inserted through the slit prevents the extrication therefrom sealing the container and providing the pilferproof feature. To open the container a cut must be made through the flap or top lid to allow the opening thereof.

BRIEF DESCRIPTION OF THE DRAWINGS

Thus by the present invention its objects and advantages will be realized the description of which should be taken in conjunction with the drawings wherein.

DETAILED DESCRIPTION OF THE PREFERRED EMBODIMENT

Figure 1:
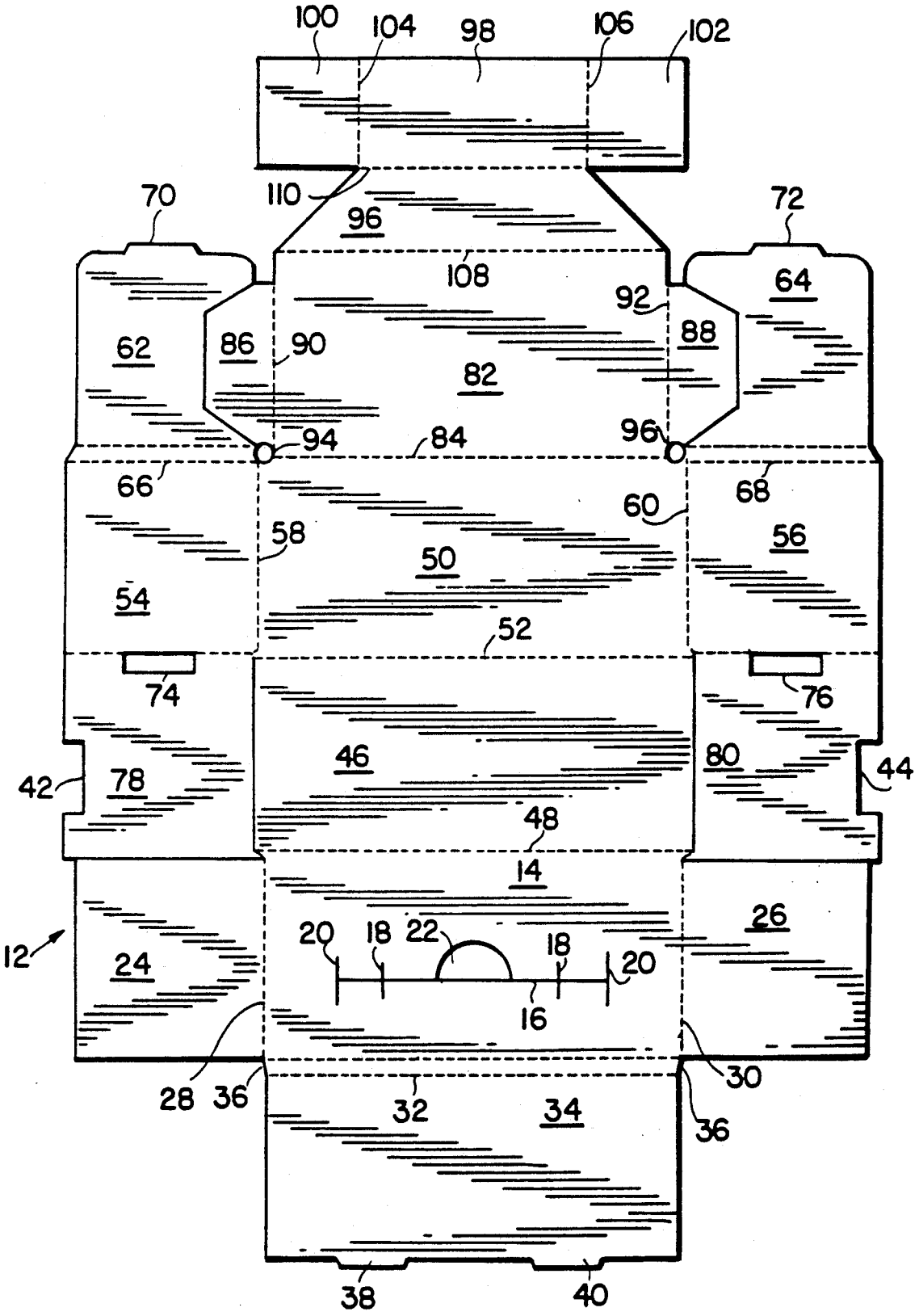
FIG. 1 is a plan view of the blank from which the container of the present invention is formed.
Figure 2:
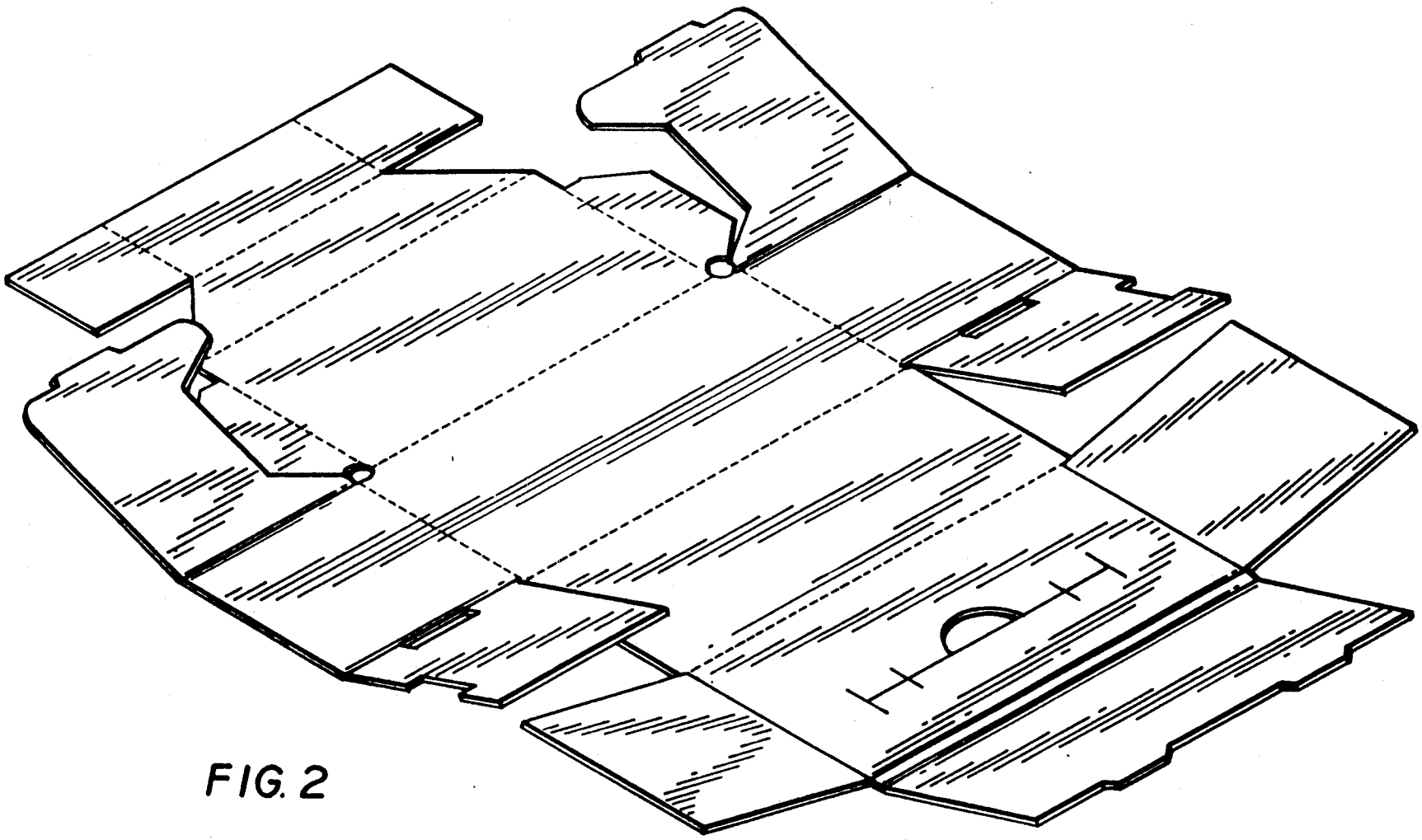
FIGS. 2 to 4 inclusive are perspective views of the various stages of assembly of the blank of FIG. 1 to form the container of the present invention.

Turning now more particularly to the drawings, the container 10 of the present invention is formed from a blank 12 which is shown in a plan view in FIG. 1.

The material out of which the blank 12 is formed is preferably corrugated paper or fiberboard but may be any material suitable for purpose. The blank 12 is preferably die cut to the configuration shown. A generally rectangular front panel 14 is provided which includes a longitudinal score there through at 16 along with oppositely disposed transverse scores 18 and 20 respectively. In addition, a half circle cut out 22 is also provided. The purpose for the scores and cut out will become apparent. Note, throughout this discussion the solid lines in the drawings illustrate a complete score through the blank whereas the dash lines just indicate fold lines.

Positioned on opposite ends of panel 14 are tabs 24 and 26 which are coupled therewith by way of respective fold lines 28 and 30. The fold lines may be scored or in some other way formed such as by pressure delineated in the blank 12.

Coupled to panel 14 along a double fold line 32 is a rectangular panel 34 of slightly smaller dimension then panel 14. This can be seen by the reduction in length of panel 34 from score lines 28 and 30 and the slight angular portions 36. At one end of panel 34 are locking tabs 38 and 40 which as will be seen are intended to be inserted in respectively formed slots 42 and 44.

On the opposite side of panel 14 is a slightly larger rectangular panel 46 coupled via fold line 48 which in turn is coupled to a slightly smaller rectangular panel 50 via fold line 52. Panels 14 (and 34) form the front of the container, panel 46 the bottom and panel 50 the rear. Accordingly, panels 14 and 50 are of the same dimensions.

Coupled to panel 50 are respective flaps 54 and 56 via respective fold lines 58 and 60. Flaps 54 and 56 include respective members 62 and 64 coupled via double fold lines 66 and 68. Members 62 and 64 include respective tabs 70 and 72 which are intended to be captured in slots 74 and 76 on members 78 and 80.

Figure 3:
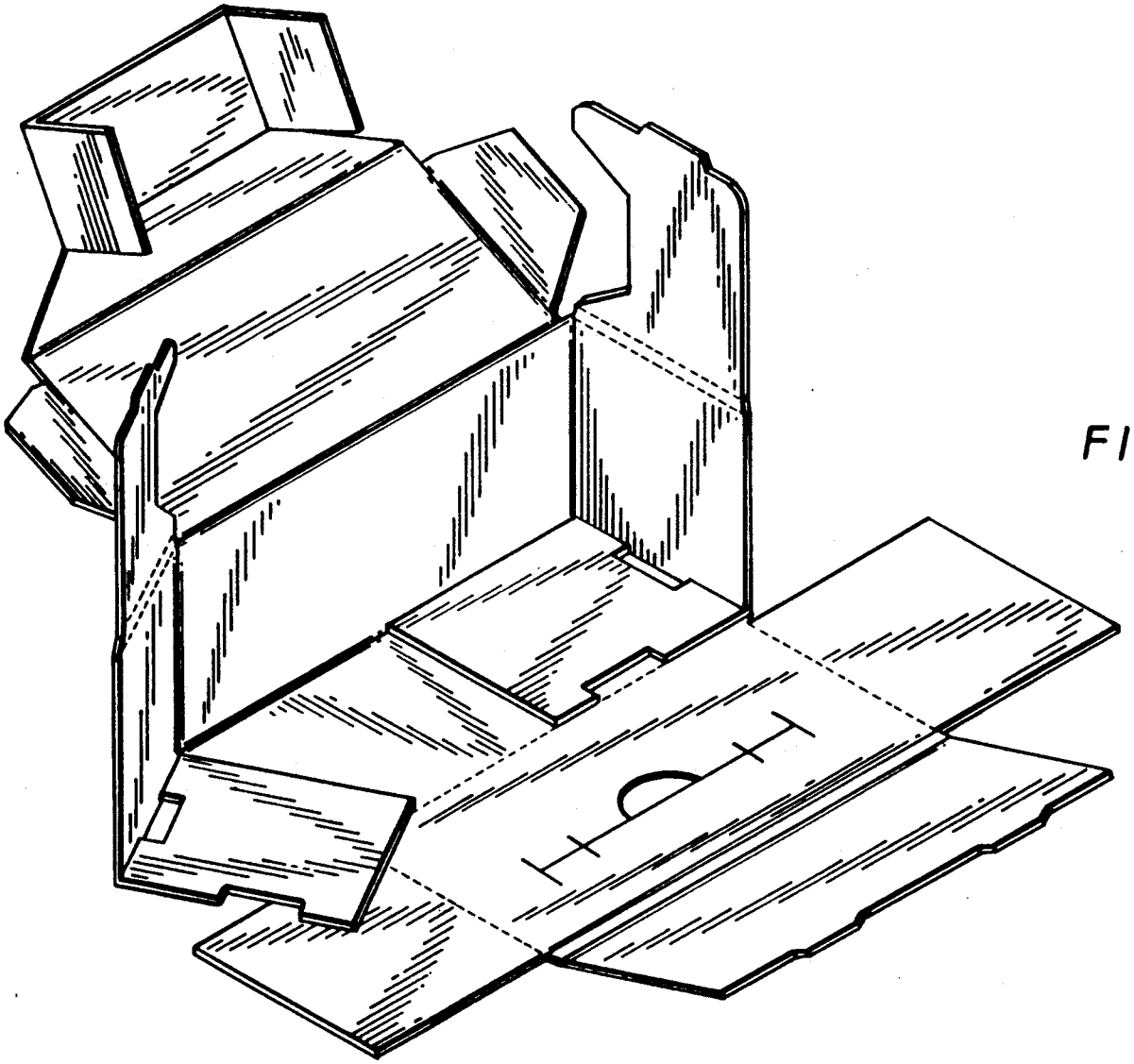
Figure 4:
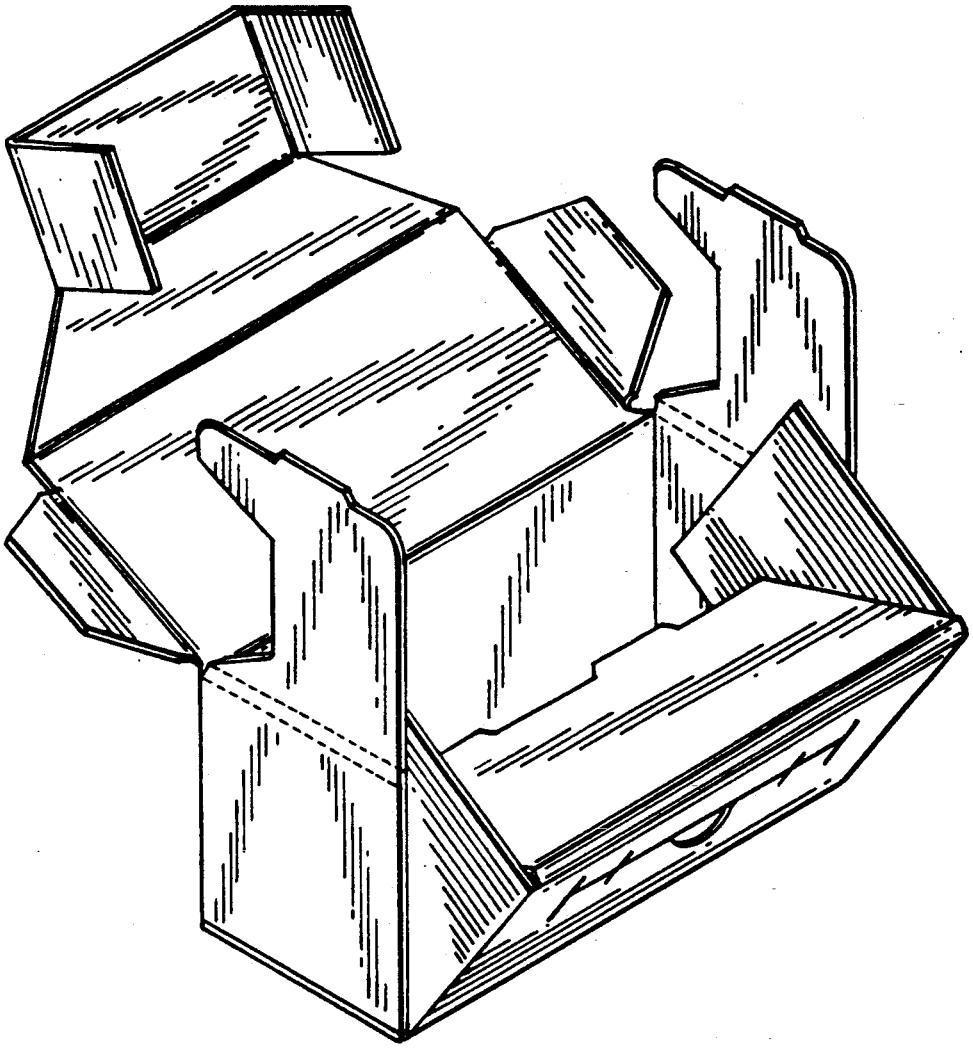
Figure 5:
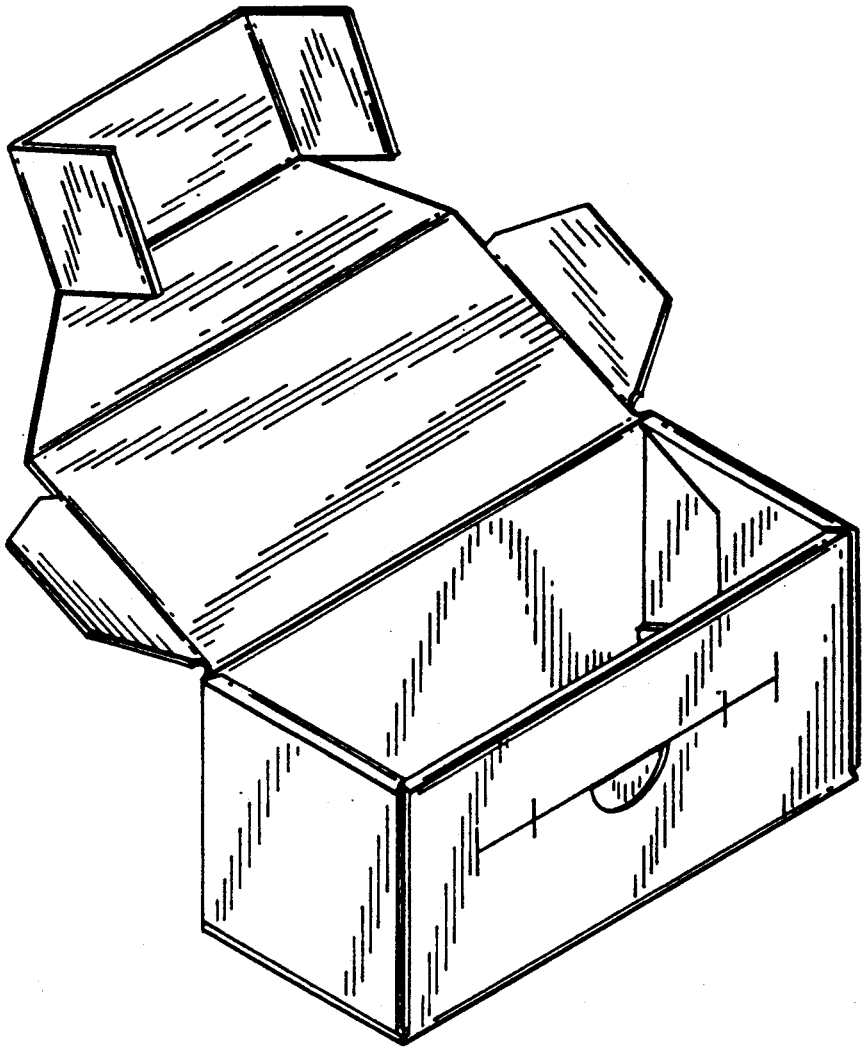
FIG. 5 is a perspective view of the container of the present invention with the lid open.
Figure 6:
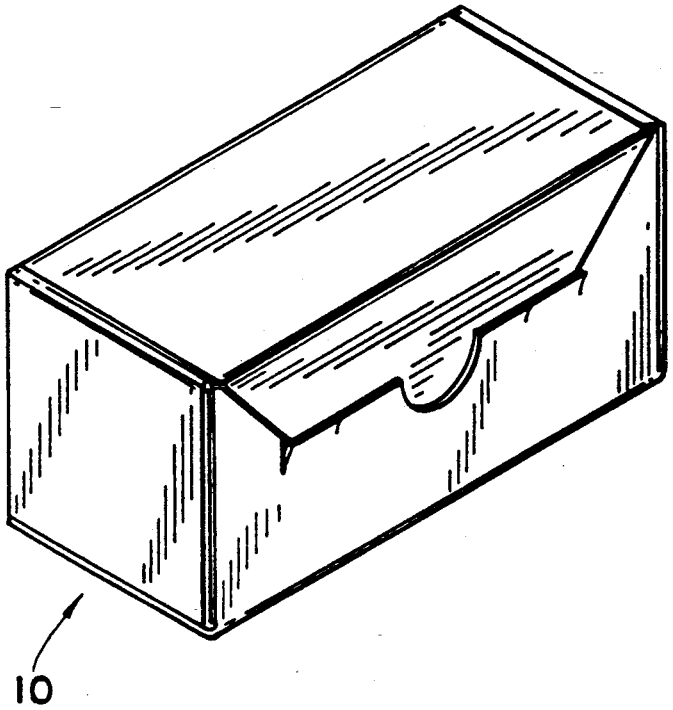
FIG. 6 is a perspective view of the container of the present invention with the lid closed.
Figure 7:
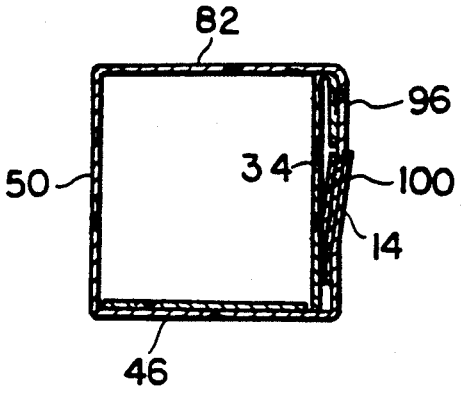
FIG. 7 is a transverse cross-sectional view taken of the container of the present invention.
Figure 8:
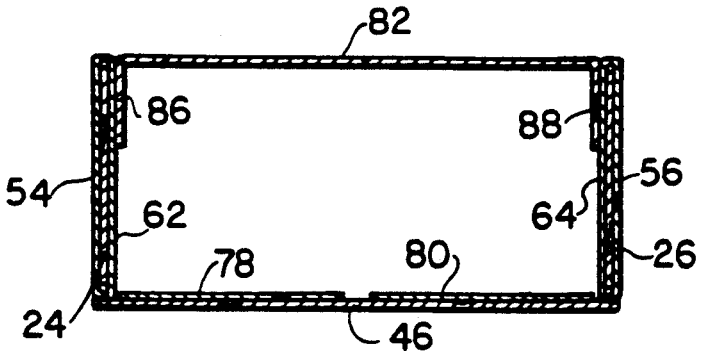
FIG. 8 is a longitudinal cross-sectional view of the container of the present invention.

Flaps 54 and 56 will provide the sidewalls of the container 10. Members 62 and 64 are intended to fold over and capture flaps 24 and 26 in the assembly of the container 10 (see FIGS. 3 and 4). Members 78 and 80 are intended to slide over panel 46 and provide the slots for tabs 38, 40 70 and 72 (see FIG. 3).

The top or lid of the container 10 is provided by rectangular panel 82 which is coupled to panel 50 via fold line 84. At each end of panel 82 are flaps 86 and 88 coupled thereto by respective fold lines 90 and 92. Circular cutouts 94 are provided in the lower corners of panel 82.

At the opposite side of panel 82 is a reduced area to flap portion 96 which includes a flange member 98 having foldable flap 100 and 102 couple via fold lines 104 and 106. Fold lines 108 and 110 allows for the folding of the flap portion 96.

As can be seen in FIGS. 2–6 the assembly of the container 10 is readily accomplished. In this regard flaps 54 and 56 are folded up towards each other. Members 78 and 80 are folded at right angles and slide over panel 46 when panel 50 is folded towards it. Panel 34 is folded behind panel 14 with flap 24 and 26 folded at right angles. Tabs 38 and 40 will be secured in slots 42 and 44. Members 62 and 64 are folded over to capture flaps 24 and 26 with tabs 70 and 72 being secured in respective slots 74 and 76.

To close and secure the lid 82, flaps 86 and 88 are folded in with flaps 100 and 102 folded flat with flange member 98. This flange member 98 is then inserted into the score 16 which may be separated by pulling out on the cutout 22. The flange member 98 is then inserted fully into the score 16 locking the lid in position. This occurs because of flap member 98 and flaps 100 and 102. Flaps 100 and 102 now abut the portion of panel 14 above the score 16 and since flap portion 96 is positioned over it, it is locked in position. To open the lid 82 would now require a cutting through of the flap portion.

Thus by the foregoing invention, its objects and advantages are realized and although a preferred embodiment has been disclosed and described in detail herein, its scope should not be limited thereby. Rather its scope should be determined by that of the appended claims.

What is claimed:

1. A container made from a single blank comprising:

a front panel having a scored portion thereof;

a bottom panel hingedly coupled to the front panel;

a rear panel hingedly coupled to the bottom panel;

a lid hingedly coupled to the rear panel;

respective first flaps hingedly coupled to opposite side of the front panel and a further panel hingedly coupled to the front panel opposite to that of the bottom panel, said further panel having first locking tabs thereon;

respective second flaps hingedly coupled to opposite sides of the rear panel, said respective second flaps including first slot means to receive said first locking tab when said further panel is folded behind said front panel and respective second locking tabs and second slots, said second flaps adapted to capture said respective first flap when said second slot receives said second locking tab to form the respective sidewalls of the container; and a locking flap coupled to said lid, wherein said locking flap includes a flange folded over and upon the insertion of said flange into the scored portion of the front panel causes a locking of the container through the abutment of the flange and a portion of the front panel.

2. The invention in accordance with claim 1 wherein container is made from corrugated paper or fiber board.

3. The invention in accordance with claim 2 wherein said scored portion is slightly larger than the flange.

4. The invention in accordance with claim 3 wherein the flange enters into a locking position with respect to the scored portion.

5. The invention in accordance with claim 4 wherein the flange when in said locking position prevents it from being disengaged therefrom.

* * * * *